US007238873B2

(12) United States Patent
Fujiwara et al.

(10) Patent No.: US 7,238,873 B2
(45) Date of Patent: Jul. 3, 2007

(54) AUTOMATIC PLAYER MUSICAL INSTRUMENT EXACTLY REPRODUCING PERFORMANCE AND AUTOMATIC PLAYER USED THEREIN

(75) Inventors: Yuji Fujiwara, Shizuoka-ken (JP); Yasuhiko Ohba, Shizuoka-ken (JP); Koichi Ishizaki, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 369 days.

(21) Appl. No.: 11/054,412

(22) Filed: Feb. 9, 2005

(65) Prior Publication Data

US 2005/0211049 A1 Sep. 29, 2005

(30) Foreign Application Priority Data

Mar. 4, 2004 (JP) ..... 2004-060623

(51) Int. Cl.
*G10H 1/00* (2006.01)

(52) U.S. Cl. ..... 84/600; 84/13; 84/21; 84/723

(58) Field of Classification Search ..... 84/600, 84/13, 723, 21
See application file for complete search history.

(56) References Cited

U.S. PATENT DOCUMENTS 4,913,026 A * 4/1990 Kaneko et al. ..... 84/21
5,022,301 A * 6/1991 Stahnke ..... 84/21
5,131,306 A 7/1992 Yamamoto
5,262,586 A * 11/1993 Oba et al. ..... 84/723
5,451,706 A * 9/1995 Yamamoto et al. ..... 84/34
5,530,198 A * 6/1996 Ishii ..... 84/21
5,568,138 A * 10/1996 Mantani ..... 341/20
5,650,580 A * 7/1997 Yamamoto et al. ..... 84/21
5,652,399 A * 7/1997 Fujiwara et al. ..... 84/21
5,663,513 A * 9/1997 Sugiyama et al. ..... 84/21
5,691,489 A * 11/1997 Fujiwara et al. ..... 84/21
5,739,450 A * 4/1998 Fujiwara et al. ..... 84/462
5,880,393 A * 3/1999 Kaneko et al. ..... 84/662
6,051,762 A * 4/2000 Fujiwara et al. ..... 84/21
6,111,174 A * 8/2000 Oba et al. ..... 84/21
6,271,447 B1 * 8/2001 Fujiwara et al. ..... 84/21
6,297,437 B1 * 10/2001 Ura et al. ..... 84/423 R
6,362,405 B2 * 3/2002 Koseki et al. ..... 84/2
6,403,872 B2 * 6/2002 Muramatsu et al. ..... 84/724

(Continued)

FOREIGN PATENT DOCUMENTS

JP 8044348 2/1996

*Primary Examiner*—Lincoln Donovan
*Assistant Examiner*—Christina Russell
(74) *Attorney, Agent, or Firm*—Harness, Dickey & Pierce, PLC

(57) ABSTRACT

An automatic player piano is equipped with solenoid-operated pedal actuators for driving the pedals in a playback; since a large quantity of induction is coupled to the solenoid, the driving signal is delayed due to long time constant so that the pedals behave differently from those in the original performance; a controller, which is incorporated in the automatic player, firstly determines a target mean current of the driving signal to be theoretically required for the reproduction of the pedal motion, and a temporary means current twice as much as the target mean current at the maximum; the controller supplies the driving signal at the temporary mean current to the solenoid in an early stage of each cycle, and, thereafter, recovers the driving signal to the target mean current so that the pedal motion becomes close to that in the original performance.

18 Claims, 6 Drawing Sheets

U.S. PATENT DOCUMENTS 6,515,213 B2 * 2/2003 Muramatsu et al. ..... 84/687
6,515,565 B1 * 2/2003 Muramatsu et al. ..... 335/299
6,858,789 B2 * 2/2005 Muramatsu et al. ..... 84/600
6,969,791 B2 * 11/2005 Fujiwara ..... 84/13
6,992,241 B2 * 1/2006 Fujiwara ..... 84/21
7,094,961 B2 * 8/2006 Ura et al. ..... 84/600
7,161,137 B2 * 1/2007 Ura et al. ..... 250/222.1
2001/0007220 A1 * 7/2001 Koseki et al. ..... 84/615
2002/0007717 A1 * 1/2002 Uehara ..... 84/600
2003/0070526 A1 * 4/2003 Muramatsu et al. ..... 84/21
2003/0133700 A1 * 7/2003 Uehara ..... 386/96
2005/0092160 A1 * 5/2005 Fujiwara ..... 84/600
2005/0145087 A1 * 7/2005 Fujiwara ..... 84/1
2005/0145781 A1 * 7/2005 Ura et al. ..... 250/222.1
2005/0150361 A1 * 7/2005 Muramatsu et al. ..... 84/626
2005/0211048 A1 * 9/2005 Fujiwara ..... 84/13
2005/0211079 A1 * 9/2005 Sasaki et al. ..... 84/723
2005/0212846 A1 * 9/2005 Shinkawa et al. ..... 347/19
2005/0235801 A1 * 10/2005 Muramatsu et al. ..... 84/13
2005/0235808 A1 * 10/2005 Ishii et al. ..... 84/600
2005/0247182 A1 * 11/2005 Sasaki et al. ..... 84/13
2006/0016325 A1 * 1/2006 Fujiwara et al. ..... 84/723
2006/0090633 A1 * 5/2006 Muramatsu ..... 84/723

* cited by examiner

AUTOMATIC PLAYER MUSICAL INSTRUMENT EXACTLY REPRODUCING PERFORMANCE AND AUTOMATIC PLAYER USED THEREIN

FIELD OF THE INVENTION

This invention relates to an automatic player musical instrument and, more particularly, to an automatic player musical instrument equipped with electric actuators for moving manipulators and an automatic player used therein.

DESCRIPTION OF THE RELATED ART

An automatic player piano is an example of the automatic player musical instrument. The automatic player piano is broken down into an acoustic piano and an automatic player. The automatic player selectively moves the manipulators, i.e., black keys, white keys and pedals so as to give rise to the hammer motion, and the strings are struck with the hammers at the end of the hammer motion so as to produce the piano tones through the vibrations of the strings.

A typical example of the automatic player piano is disclosed in Japanese Patent Application laid-open No. Hei 8-44348. The Japanese Patent Application laid-open is corresponding to Japanese Patent Application No. Hei 7-159700, which is a divisional application of Japanese Patent Application No. Hei 2-9551. The parent application, i.e., Japanese Patent Application No. Hei 2-9551 was filed with the benefit of the domestic priority right of Japanese Patent Application No. Hei 1-10176, and U.S. Ser. No. 07/467,268 was filed with the benefit of the Convention Priority Right of Japanese Patent Application No. Hei 1-10176. The U.S. Patent Application was granted, and U.S. Pat. No. 5,131,306 was assigned to the U.S. Patent Application.

The prior art automatic player disclosed in the Japanese Patent Application laid-open includes solenoid-operated pedal actuators for driving the pedals, pedal sensors for determining the current pedal positions and a PWM controller for driving the solenoid-operated pedal actuators. The PWM controller determines the difference between the target pedal position and the current pedal position. When the PWM controller finds the difference between the target pedal position and the current pedal position, the PWM controller changes the driving signal so as to minimize the difference. However, the time lag is not perfectly removed from the pedal motion. In other words, the original pedal motion is not reproduced, and, accordingly, the user feels the playback slightly different from the original performance.

SUMMARY OF THE INVENTION

It is therefore an important object of the present invention to provide an automatic player musical instrument, through which an original performance is exactly reproduced.

It is also an important object of the present invention to provide an automatic player, which is incorporated in the automatic player musical instrument.

The present inventors contemplated the problem inherent in the prior art automatic player piano, and noticed a large quantity of inductance coupled to the solenoid. The resistance against the driving signal was not so large that the driving circuit had to drive the solenoids against the large time constant. The large time constant was unavoidable in so far as the manipulators, i.e., the keys and pedals were driven by the electric actuators. Especially, the heavy load was exerted on the solenoid-operated plunger actuators, and the large solenoid was required for the plunger actuators. Thus, the time lag was serious. The present inventors concluded that, even though the large time constant retarded the electric actuators, it was possible to make the manipulators catch up at the early stage of the its motion.

To accomplish the object, the present invention proposes to temporarily increase or decrease the current of a driving signal.

In accordance with one aspect of the present invention, there is provided an automatic player musical instrument for a performance without any fingering of a human player comprising a musical instrument including plural combinations of links selectively actuated by the human player for designating tones to be produced and plural tone generating members selectively activated by the plural combinations of links for producing the tones, and an automatic player associated with the plural combinations of links and including at least one actuator having a current path coupled with inductance and responsive to a driving signal flowing through the current path so as to exert force on a predetermined link of one of the plural combinations of links, thereby actuating the aforesaid one of the plural combinations of links, a data processor analyzing pieces of music data so as to determine target positions of the predetermined link periodically varied, a target value of current of the driving signal for bringing the predetermined link from one of the target positions to the next target position at the end of a time period without consideration of the inductance and a temporary value of the current to be supplied to the current path in an early stage of the time period so as to make the predetermined link closer to the next target position than the predetermined link driven with the driving signal at the target value and a driving circuit connected between the data processor and the aforesaid at least one actuator, supplying the driving signal at the temporary value to the current path in the early stage and varying the driving signal from the temporary value to the target value at the end of the early stage.

In accordance with another aspect of the present invention, there is provided an automatic player for selectively driving plural combinations of links incorporated in a musical instrument comprising at least one actuator having a current path coupled with inductance and responsive to a driving signal flowing through the current path so as to exert force on a predetermined link of one of the plural combinations of links, thereby actuating the aforesaid one of the plural combinations of links, a data processor analyzing pieces of music data so as to determine target positions of the predetermined link periodically varied, a target value of current of the driving signal for bringing the predetermined link from one of the target positions to the next target position at the end of a time period without consideration of the inductance and a temporary value of the current to be supplied to the current path in an early stage of the time period so as to make the predetermined link closer to the next target position than the predetermined link driven with the driving signal at the target value, and a driving circuit connected between the data processor and the aforesaid at least one actuator, supplying the driving signal at the temporary value to the current path in the early stage and varying the driving signal from the temporary value to the target value at the end of the early stage.

BRIEF DESCRIPTION OF THE DRAWINGS

The features and advantages of the automatic player musical instrument and automatic player will be more clearly understood from the following description taken in conjunction with the accompanying drawings, in which.

DESCRIPTION OF THE PREFERRED EMBODIMENTS

In the following description, term "front" is indicative of a position closer to a player, who is sitting on a stool for fingering, than a position modified with term "rear". A line drawn between a front position and a corresponding rear position extends the "fore-and-aft" direction, and the lateral direction crosses the fore-and-aft direction at right angle.

First Embodiment

Figure 1:
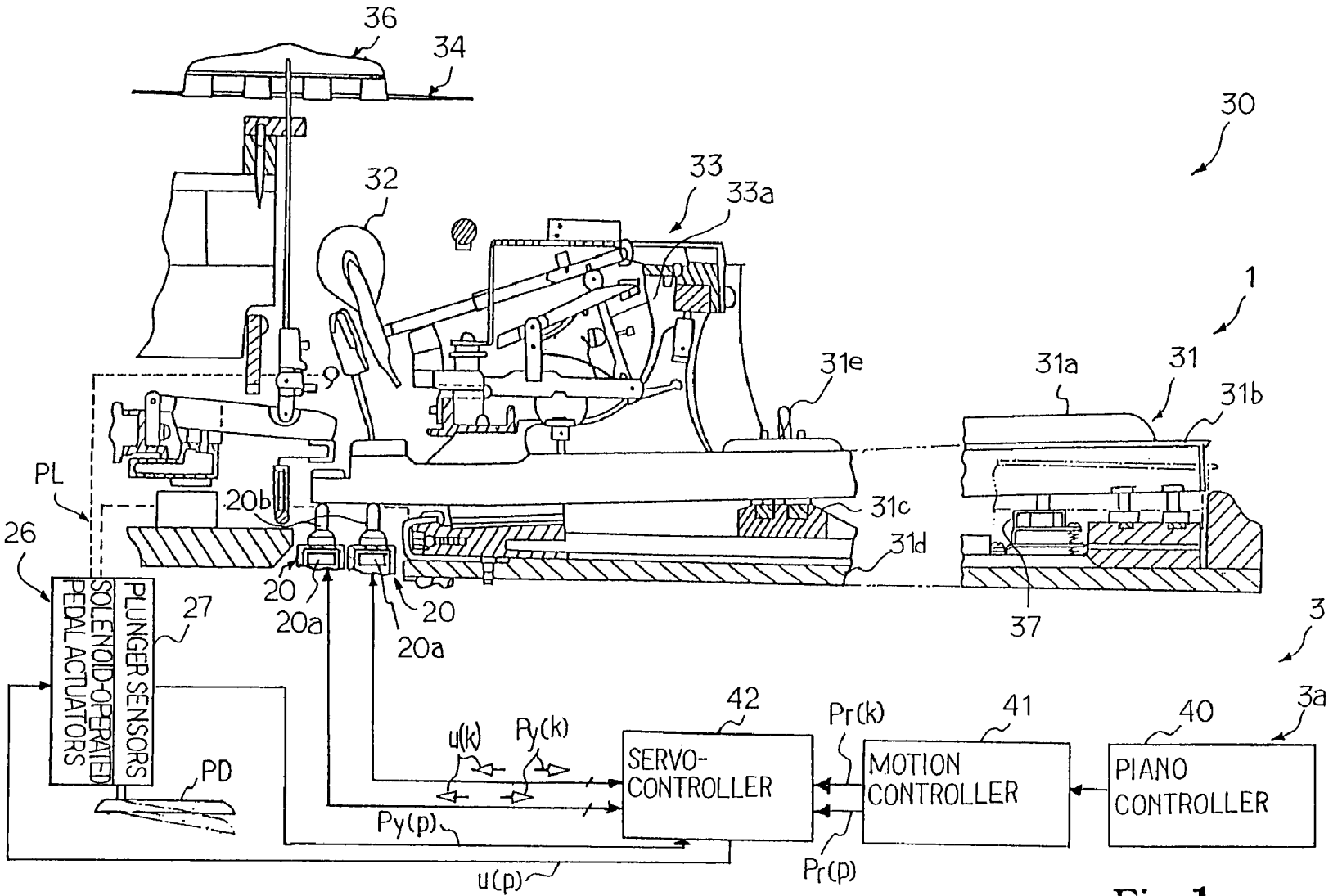
FIG. 1 is a schematic side view showing the structure of an automatic player piano according to the present invention.

Referring first to FIG. 1 of the drawings, an automatic player piano 30 embodying the present invention largely comprises an acoustic piano 1 and an automatic player 3. While a human pianist plays a piece of music on the acoustic piano 1, the automatic player 3 stands idle. The automatic player 3 responds to user's instruction for playback, and reenacts the performance without any fingering by the human pianist. Although a recording system is further incorporated in the automatic player piano 1 for recording a performance on the acoustic piano 1, the system configuration and system behavior are well known to persons in the art, and detailed description is omitted for the sake of simplicity. The acoustic piano 1 and automatic player 3 is hereinafter described in detail.

Acoustic Piano

In this instance, the acoustic piano 1 is a standard grand piano. Of course, an upright piano is available for the automatic player piano 30. The acoustic piano 1 includes a keyboard 31, hammers 32, action units 33, strings 34, dampers 36 and pedals PD. The keyboard 31 includes black keys 31*a* and white keys 31*b*, and the black keys 31*a* and white keys 31*b* are laid on the well-known pattern. A balance rail 31*c* laterally extends over a key bed 31*d*, and the black keys 31*a* and white keys 31*b* rest on the balance rail 31*c* in such a manner as to cross the balance rail 31*c* at right angle. Balance pins 31*e* upwardly project from the balance rail 31*c* at intervals, and offer fulcrums to the black/white keys 31*a*/31*b*. When a user depresses the front end portions of the black and white keys 31*a*/31*b*, the front end portions are sunk toward the key bed 31*d*, and the rear portions are lifted like a seesaw.

The black/white keys 31*a*/31*b* are respectively linked with the action units 33 so that depressed keys 31*a*/31*b* actuate the associated action units 33. The hammers 32 rest on the jacks 33*a*, which form respective parts of the action units 33, and are driven for rotation through the escape of the jacks 33*a*. The strings 34 are stretched over the associated hammers 32, and are struck with the associated hammers 32 at the end of the rotation. The dampers 36 are held in contact with the associated strings 34, and are lifted by the associated depressed keys 31*a*/31*b* so as to permit the associated strings 34 to vibrate for producing piano tones. When the user releases the depressed keys 31*a*/31*b*, the dampers 36 are brought into contact with the associated strings 34 on the way of the associated keys 31*a*/31*b* to the rest positions.

The pedals PD are connected to the dampers 36 and keyboard 31 through link works PL, and are provided under the key bed 31*d*. The human player steps on the pedals PD during the performance for modifying the piano tones. One of the pedals PD is called as a "damper pedal", and makes the piano tones prolonged. Another of the pedals PD is called as a "soft pedal", and makes the piano tones reduced in loudness.

The automatic player 3 includes a controller 3*a*, an array of solenoid-operated key actuators 20 and solenoid-operated pedal actuators 26. The controller 3*a* has a data processing capability, and suitable computer programs are installed therein. The solenoid-operated key actuators 20 and solenoid-operated pedal actuators 26 are connected to the controller 3*a*. The solenoid-operated key actuators 20 are provided under the rear portions of the black and white keys 31*a*/31*b*, and the controller 3*a* selectively energizes the solenoid-operated key actuators 20 for driving the associated black and white keys 31*a*/31*b* without any fingering of the human player. On the other hand, the solenoid-operated pedal actuators 26 are provided over the rear portions of the pedals PD, and give rise to the associated pedals PD without any step-on of the human player. The total weight of the pedal system PD/PL/36, which the solenoid-operated pedal actuator 26 is expected to drive, is heavier than the total weight of the key/action unit/each damper 36/each hammer 32, which the solenoid-operated key actuator 20 is expected to drive. Thus, the solenoid 28 is expected to create the magnetic field stronger than that created by the solenoid of the solenoid-operated key actuator 20.

The solenoid-operated key actuators 20 have respective built-in plunger sensors 20*a*, respective solenoids (not shown) and respective plungers 20*b*, and the plungers 20*b* have the respective tips beneath the rear portions of the black and white keys 31*a*/31*b*. The solenoid-operated pedal actuators 26 also have respective plunger sensors 27, respective solenoids 28 and respective plungers 29 (see FIG. 2). The plungers 29 are inserted into the link works PL, and drive the dampers 36 and keyboard 31 as if the human player steps on the pedals PD.

When a user wishes to reproduce a performance, the user instructs the controller 3*a* to prepare for a playback, and a set of MIDI (Musical Instrument Digital Interface) music data codes, which represents the performance, is loaded to the controller 3*a*. The controller 3*a* sequentially processes the MIDI music data codes so as to determine reference trajectories on which the black and white keys 31*a*/31*b* are to travel. When timing at which a certain key 31*a*/31*b* is to be moved, the controller 3*a* supplies a driving signal u(k) to the solenoid-operated key actuator 20 under the certain key 31*a*/31*b*, and energizes the solenoid (not shown) with the driving signal u(k). Then, the plunger 20*b* projects upwardly, and pushes the rear portion of the certain key 31*a*/31*b*. The built-in plunger sensor 20*a* reports the current plunger position, i.e., the current key position through a plunger position signal Py(k) to the controller 3*a*. The controller 3*a* compares the current plunger position with the corresponding target plunger position on the reference trajectory to see whether or not the certain key 31*a*/31*b* accurately travels on the reference trajectory. If the answer is given negative, the controller 3*a* varies the mean current of the driving signal u(k) so as to accelerate or decelerate the plunger 20*b*. On the other hand, when the controller 3*a* confirms that the certain key 31*a*/31*b* accurately travels on the reference trajectory, the controller 3*a* keeps the driving signal u(k). Thus, the controller 3*a* sequentially drives the plungers 20*b* so as to give rise to the key motion same as that in the original performance. The black and white keys 31*a*/31*b* actuate the associated action units 33, and cause the hammers 32 to be brought into collision with the associated strings 34 at the end of the rotation for producing the piano tones.

The human player prolonged a piano tone in the original performance. When the timing at which the prolonged piano tone is to be reproduced in the playback, the controller 3*a* also determines a reference trajectory for the damper pedal PD, and the mean current of the driving signal u(p). The value of the mean current is predetermined times larger than the value of the means current to be required for moving the pedal PD against the heavy load. The driving signal u(p) is supplied to the solenoid 28 so that a magnetic field is created around the plunger 29. The magnetic force is exerted on the plunger 29 so that the plunger 29 gives rise to the pedal motion. Although a time lag takes place due to the large time constant, the plunger 29 is rapidly accelerated so that the pedal PD can catch up to the target position on the reference trajectory at the early stage in the plunger motion. While the plunger 29 is moving the pedal PD and link work PL, the pedal sensor 27 reports the current plunger position, i.e., the current pedal position through a plunger position signal Py(p) to the controller 3*a*. When the pedal PD catches up to the target position on the reference trajectory, the controller 3*a* recovers the driving signal u(p) to the value of the mean current required for moving the pedal PD against the heavy load. After the catch-up, the controller 3*a* varies or keeps the mean current of the driving signal Py(p) as similar to the driving signals Py(k) supplied to the solenoid-operated key actuators 20.

A computer program runs on the controller 3*a*, and the controller 3*a* achieves the above-described tasks through the execution of the program instructions. The function of the controller 3*a* is broken down into a function of a piano controller 40, a function of a motion controller 41 and a function of a serve-controller 42 as shown in FIG. 1.

In detail, the piano controller 40 sequentially fetches the MIDI music data codes from a suitable data source, and supplies the MIDI music data codes at the timing to reproduce each of the piano tones. A set of MIDI music data codes contains pieces of music data, which define the key motion and pedal motion, and pieces of duration data representative of the lapse of time between an event and the next event. The piano controller 40 determines the timing on the basis of the pieces of duration data, and supplies the piece or pieces of music data representative of the key position and/or pedal motion to the motion controller 41.

The motion controller 41 analyzes the pieces of music data, and determines the reference trajectories. The reference trajectory means a series of target key positions Pr(k) varied with time or a series of target pedal positions Pr (p) also varied with time. The motion controller 41 supplies a piece of key position data representative of the target key positions Pr(k) and a piece of pedal position data representative of the target pedal positions Pr(p) to the servo-controller 42 at intervals.

The servo-controller 42 is connected to the solenoid-operated key actuators 20, built-in plunger sensors 20*a*, solenoid-operated pedal actuators 26 and plunger sensors 27. The servo-controller 42 determines the mean current of the driving signal u(k) required for moving the key 31*a*/31*b* to the next target key position and the means current of the driving signal u(p) required for moving the pedals PD to the next target pedal position on the basis of the piece of key position data and the piece of pedal position data, respectively, and adjusts the driving signal u(k) and driving signal u(p) to the duty ratio equivalent to the mean current and the duty ratio equivalent to the mean current. Thus, a pulse width modulator 42*a* (see FIG. 2) is incorporated in the servo-controller 42.

While the plungers 20*b* and 29 are moving in the magnetic fields, the built-in plunger sensors 20*a* and 27 determines the current key positions and current pedal positions, and periodically reports the current key positions and current pedal positions to the servo-controller 42 as the key position signals Py(k) and pedal position signals Py(p). The servo-controller 42 compares the current key positions and current pedal positions with the corresponding target key positions and corresponding pedal positions to see whether or not the keys 31*a*/31*b* and pedals PD exactly travel on the reference trajectories. If the answer is given negative, the servo-controller 42 varies the mean current of the driving signals u(k) and mean current of the driving signals u(p). If, on the other hand, the answer is given affirmative, the servo-controller 42 keeps the means current at the previous values.

Controller

Figure 2:
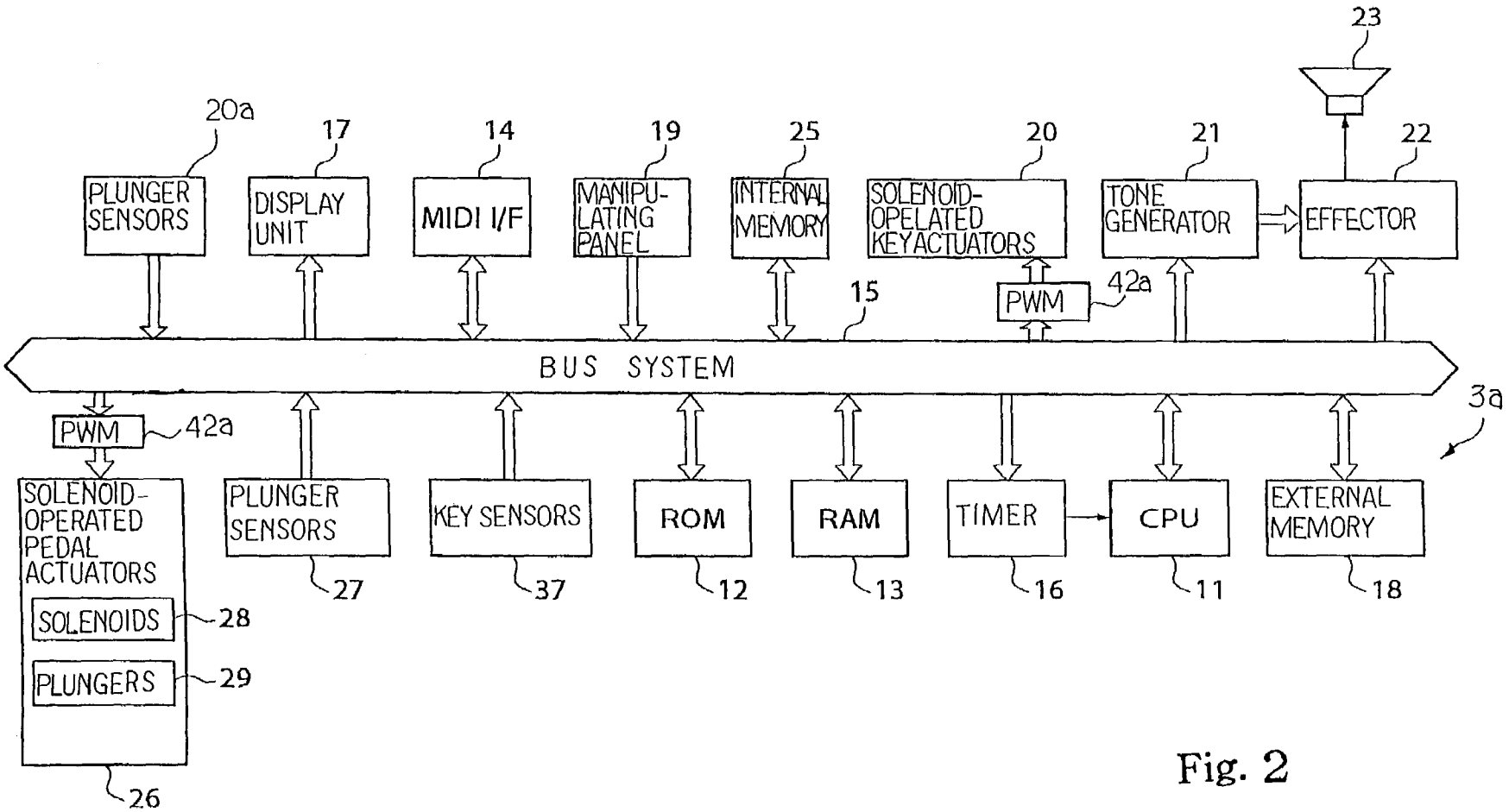
FIG. 2 is a block diagram showing the system configuration of a controller incorporated in the automatic player piano.

Turning to FIG. 2, the controller 3*a* includes a central processing unit 11, which is abbreviated as "CPU", a read only memory 12, which is abbreviated as "ROM", a random access memory 13, which is abbreviated as "RAM", a MIDI interface 14, which is abbreviated as "MIDI/IF", a bus system 15 and a timer 16. The central processing unit 11, read only memory 12, random access memory 13, MIDI interface 14 and timer 16 are connected to the bus system 15, and the central processing unit 11 communicates with other system components through the bus system 15.

The central processing unit 11 is the origin of the data processing capability, and computer programs are stored in the read only memory 12. The central processing unit 11 sequentially fetches program instructions, which form in combination the computer programs, from the read only memory 12, and performs a given data processing expressed by the program instructions. Parameter tables and coefficients, which are required for the data processing, are further stored in the read only memory 12. The random access memory 13 offers a temporary data storage to the central processing unit 11, and serves as a working memory. A predetermined memory area is assigned to flags.

The MIDI interface 14 is connected to another musical instrument or a personal computer system through a MIDI cable, and MIDI music data codes are output from or input to the MIDI interface 14. The lapse of time is measured with the timer 16, and the central processing unit 11 reads the time or lapse of time on the timer 16 so as to determine the timing at which an event is to occur. Moreover, the timer 16 periodically makes the main routine program branch to subroutine programs through timer interruption. The timer 16 may be a software timer.

The controller 3*a* further includes a display unit 17, a manipulating panel 19, the pulse width modulator 42*a*, a tone generator 21, an effector 22, an internal data memory 25 and interfaces connected to an external memory 18, key sensors 37, plunger sensors 20*a*/27 and a sound system 23. These system components 17, 19, 42*a*, 21, 22, 25 and interfaces are also connected to the bus system 15 so that the central processing unit 11 is also communicable with those system components 17-25 and interfaces. The pulse width modulator 42*a* may be integrated with the solenoid-operated key actuators 20. In this instance, the central processing unit 11 supplies a control signal indicative of the target duty ratio of the driving signals through an interface to the pulse width modulator 42*a*.

The display unit 17 is a man-machine interface. In this instance, the display unit 17 includes a liquid crystal panel. Character images for status messages and prompt messages are produced in the display unit 17, and symbols and images of scales/indicators are further produced in the display unit 17 so that the users acquire status information representative of the current status of the automatic player piano 30 from the display unit 17. Images of notes on the staff notation are further produced on the display unit 16, and the users play pieces of music with the assistance of the notes on the staff notation.

Button switches, ten keys and levers are arrayed on the manipulating panel 19. The users selectively push and move the switches, keys and levers so as to give their instructions to the controlling system 3*a*. The pulse width modulator 42*a* is responsive to pieces of control data representative of the mean current of the driving signals u(k)/u(p) so as to adjust the driving signals u(k)/u(p) to the target duty ratio.

The tone generator 21 produces a digital audio signal on the basis of the MIDI music data codes, and supplies the digital audio signal to the effector 22. The effector 22 is responsive to the control data codes representative of effects to be imparted to the tones so that the digital audio signal is modified in the effector 22. A digital-to-analog converter is incorporated in the effector 22. The digital audio signal is converted to an analog audio signal, and the analog audio signal is supplied to the sound system 23. The analog audio signal is equalized and amplified, and, thereafter, converted to electronic tones. Thus, the keyboard musical instrument can produce the electronic tones instead of the piano tones generated through the vibrating strings 34.

The internal data memory 25 is much larger in data holding capacity than the random access memory 13, and sets of MIDI music data codes are stored in the internal data memory 25. In this instance, a flash memory is used as the internal data memory 25. Sets of MIDI music data codes are transferred from an external data source through the MIDI interface 14 to the internal data memory 25 or from the external memory 18 through the interface. Various sorts of large-capacity memories are available for the controller 3*a*.

In this instance, the external memory 18 is implemented by a disk driver and portable memory devices such as, for example, flexible disks or compact disks. The key sensors 37 are provided under the front portions of the black and whit keys 31*a*/31*b*, and form parts of the recording system. The key sensors 37 are respectively associated with the black and white keys 31*a*/31*b*, and report the current key positions of the associated black and white keys 31*a*/31*b* to the controller 3*a*. The controller 3*a* analyzes the current key positions so as to determine the key motion. The controller 3*a* codes the pieces of music data, which express the key motion, into the formats defined in the MIDI protocols. Thus, the performance on the keyboard 31 is recorded in a set of MIDI music data codes.

Computer Program

The central processing unit 11 reiterates the main routine program, and conditionally enters several sub-routine programs. While the main routine program is running on the central processing unit 11, a user gives his or her instruction for the playback to the central processing unit 11, and the central processing unit raises a flag indicative of the playback mode. Then, the main routine program periodically branches to one of the subroutine programs for the playback, and the central processing unit 11 sequentially fetches and analyzes the MIDI music data codes for selectively driving the solenoid-operated key actuators 20 and solenoid-operated pedal actuators 26 in the subroutine program for the playback.

Figure 3:
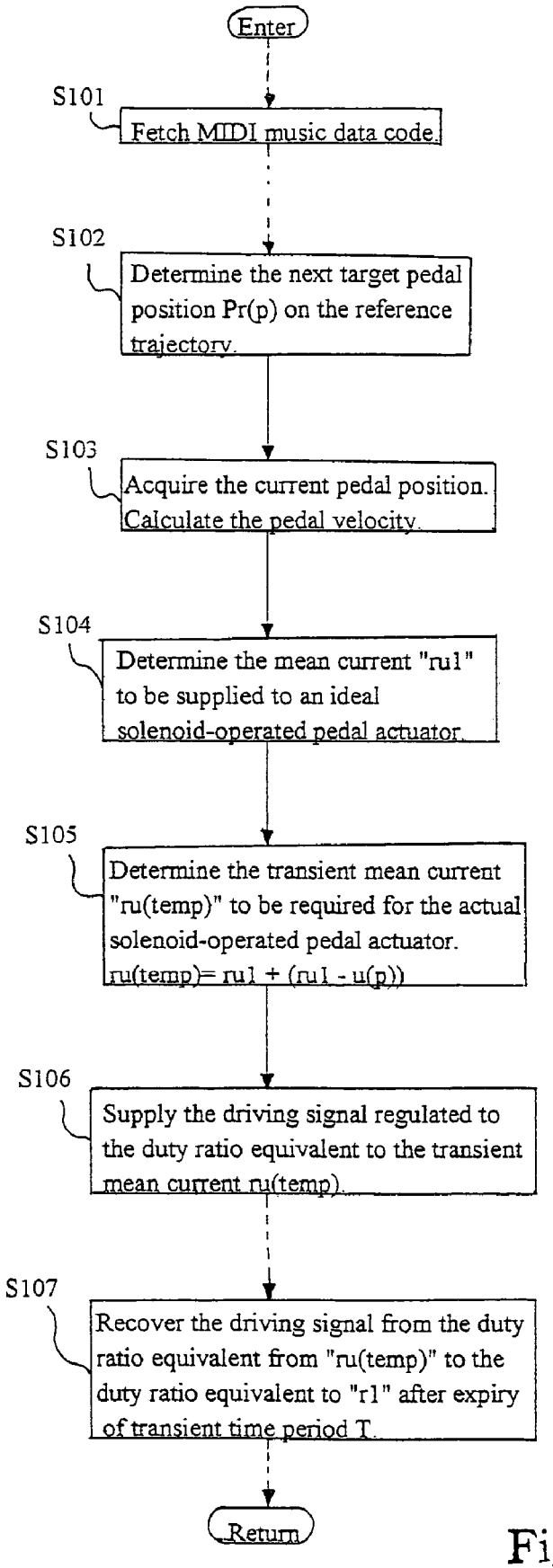
FIG. 3 is a flowchart showing a part of a subroutine program for driving pedals.

FIG. 3 shows a part of the subroutine program for the playback. The user has already given the instruction for the playback to the controller 3*a*, and the central processing unit 11 has raised the flag for indicative of the playback.

The main routine program periodically branches to the subroutine program for the playback. The central processing unit 11 is assumed to fetch the MIDI music data code representative of the effect of the damper pedal PD at step S101 after the entry into the subroutine program. Then, the central processing unit 11 raises a flag indicative of the pedal effect. While the flag is not raised, the central processing unit 11 skips steps S102 to S107, and concentrates its efforts on the data processing on the note events. On the other hand, while the flag has been raised, the central processing unit proceeds to step S102, and reiterates step S102 to S107 at intervals of 4 milliseconds. In other words, the target pedal positions Pr(p) on the reference trajectory are supplied to the servo-controller 42 at intervals of 4 milliseconds, and the servo-controller 42 recalculates the mean current ru1 on the basis of the target pedal position Pr(p) and the current pedal position Py(p) at intervals of 4 milliseconds. The time period between the recalculation and the next recalculation is hereinafter referred to as "recalculation cycle". In this instance, the recalculation cycle is 4 milliseconds.

When the central processing unit 11 notices the MIDI music data code representing the pedal effect, the central processing unit 11 determines the reference trajectory, i.e., a series of target pedal positions Pr(p) varied with time for the damper pedal PD as the motion controller 41, and supplies the first target pedal position Pr(p) to the servo-controller 42 as by step S102.

The servo-controller 42 checks the pedal position signal Py(p) to specify the current pedal position as by step S103. The servo-controller 42 calculates the difference between the current pedal position and the first target pedal position Pr(p), and determines a target pedal velocity v(p) on the basis of the difference and the time interval.

Figure 4:
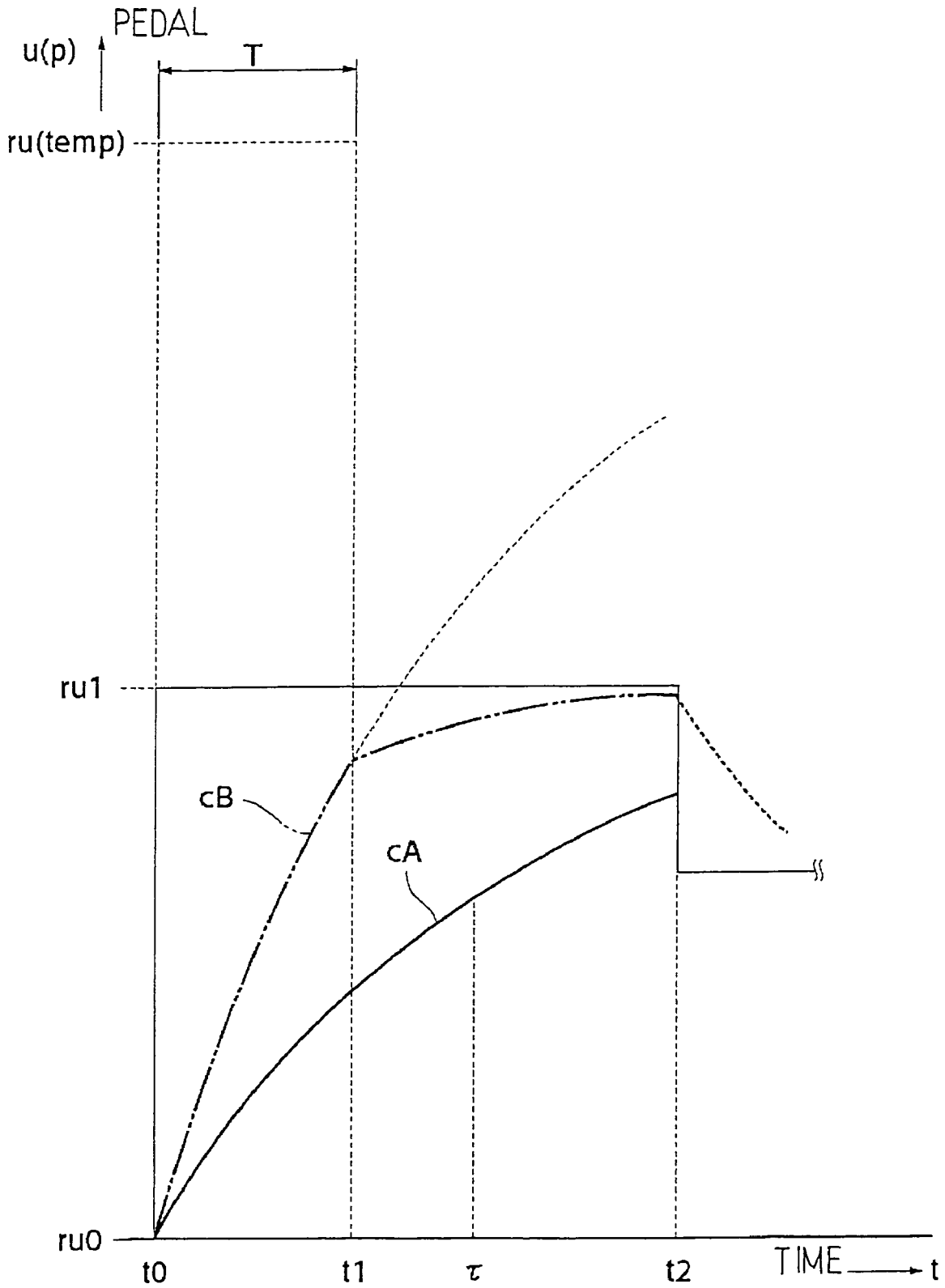
FIG. 4 is a graph showing mean current of a driving signal varied with time.
Figure 5:
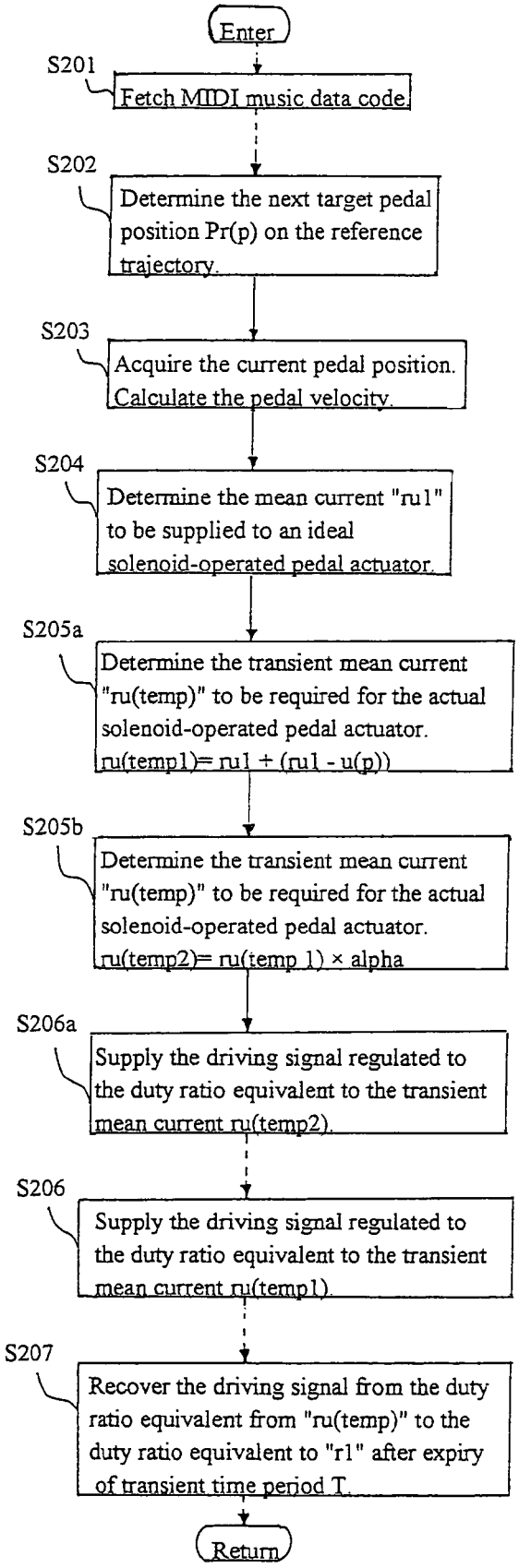
FIG. 5 is a flowchart showing a part of a subroutine program executed in an automatic player in another automatic player piano for driving pedals.

Subsequently, the central processing unit 11 determines the mean current ru1, which is expected to make the damper pedal PD timely reach the first target pedal position Pr(p) on the condition that an ideal solenoid-operated pedal actuator is installed, as by step S104. The term "ideal solenoid-operated pedal actuator" means that the induction of the solenoid 28 and resistance against the driving signal permit the mean current to reach ru1 at time t2 (see FIG. 4).

Upon determination of the mean current ru1, the central processing unit 11 calculates a temporary mean current ru(temp) as by step S105. The temporary mean current ru(temp) is given as $$ru(\text{temp})=ru1+(ru1-u(p)) \quad \text{Equation 1}$$

where u(p) is the mean current determined on the basis of the previous target pedal position Pr(p). In the graph shown in FIG. 4, u(p) is equal to ru0 at t0.

The central processing unit 11 requests the pulse width modulator 42*a* to supply the driving signal, which is adjusted to the duty ratio equivalent to the value of the temporary mean current ru(temp), to the solenoid-operated pedal actuator 26 associated with the damper pedal PD as by step S106.

Assuming now that the damper pedal PD is staying at the rest position with the driving signal at ru(0), the central processing unit 11 calculates the mean current ru on the basis of the first target pedal position Pr(p) at step S104 and temporary mean current ru(temp) at step S105. If the pulse width modulator 42*a* supplies the driving signal, which is adjusted to the duty ratio equivalent to the mean current ru1, to the solenoid-operated pedal actuator 26 as similar to the prior art automatic player, the mean current rises along plots cA (see FIG. 4) due to the large time constant Tau, and the mean current in the solenoid 28 does not reach ru1 at time t2. The time period between t0 and t2 is equal to 4 milliseconds.

On the other hand, the pulse width modulator 42*a* adjusts the driving signal at ru(temp), which is larger in value than ru1, according to the present invention, and supplies the driving signal to the solenoid-operated pedal actuator 26. Then, the mean current in the solenoid 28 rapidly rises as indicated by plots cB, and becomes much closer to ru1 at time t1 than that in the prior art automatic player does. Accordingly, the damper pedal PD is rapidly accelerated, and reaches a pedal velocity close to the target pedal velocity v(p).

Turning back to FIG. 3, while the pulse width modulator 42*a* is supplying the driving signal at ru(temp), the central processing unit 11 measures the lapse of time with the timer 16, and concentrates the efforts on the data processing on the not events. When the time period T is expired, the central processing unit 11 changes the duty ratio from the value equivalent to the temporary mean current ru(temp) to the value equivalent to the mean current r1 as by step S107, and the mean current in the solenoid 28 is gradually increased toward ru1 as indicated by plots between time t1 and time t2. In this instance, time period T is 1.5 milliseconds. The time period in which the driving signal is adjusted to the temporary means current ru(temp) is referred to as "transient time period".

As will be understood, the mean current in the solenoid 28 is boosted with the temporary mean current ru(temp) in the transient time period T. As a result, the solenoid-operated pedal actuator 26 rapidly accelerates the pedal PD as if the human player steps thereon. Thus, the automatic player 3 according to the present invention exactly reproduces the original pedal motion, and makes the performance much closer to the original performance than the performance reproduced through the prior art automatic player.

In the above-described embodiment, the solenoid-operated key actuator 26 steps down the pedal PD. However, when the MIDI music data code is indicative of the recovery toward the rest position, the motion controller 41 supplies the target pedal position Pr(p) lower than the previous target pedal position Pr(p), and the servo-controller 42 downwardly moves the plunger 29. In this situation, u(p) is larger in value than ru1 so that the temporary mean current ru(temp) is smaller than the mean current ru1.

From equation 1, it is understood that the maximum temporary means current ru(temp) is twice as much as the mean current ru1 in case where the previous mean current u(p) is zero. Thus, the ratio of the temporary mean current ru(temp) to the mean current ru1 is not so large that the pulse width modulator 42*a* can keep the pedal motion stable without chattering.

The present inventors confirmed that the pedal motion was stable under the conditions that the ratio of the mean current ru1 to the temporary mean current ru(temp) was equal to or less than 2 and that the ratio of recalculation cycle Tr to the transient time T was equal to or less than 1.5/4. In case where the ratios ru(temp)/ru1 and T/Tr widely exceeded 1.5/4 and 2, an overshoot and undershoot were observed. However, even if the ratio of ru(temp)/ru1 is greater than 2, the pedal motion is still stable in so far as the ratio of T/Tr does not widely exceed 1.5/4. Similarly, even if the ratio of T/Tr is greater than 1.5/4, the pedal motion is still stable in so far as the ratio of T/Tr does not widely exceed 2. Thus, the ratios described in the embodiment are merely an example.

Second Embodiment

Another automatic player piano embodying the present invention also largely comprises an acoustic piano and an automatic player. The acoustic piano is similar in structure to the acoustic piano 1, and the automatic player is similar in system configuration to the automatic player 3. Only the computer program for the pedal control is different from that shown in FIG. 3. For this reason, FIGS. 1 and 2 are referred to in the following description, and the following description is focused on the computer program.

Steps S201, S202, S203, S204, S205*a*, S206 and S207 are same as steps S101, S102, S103, S104, S105, S106 and S107, respectively, and description on these steps are omitted for avoiding the repetition. The difference from the computer program shown in FIG. 3 is that the mean current is twice stepped down.

Upon determination of the mean current ru1, the central processing unit 11 calculates the temporary mean current ru(temp 1) at step S205*a* as similar to the temporary mean current ru(temp). Subsequently, the central processing unit determines a boost mean current ru(temp 2) as by step S205*b*.

$$ru(\text{temp2})=ru(temp1)\times\text{alpha} \quad \text{Equation 2}$$

where alpha is a coefficient. When the pedal PD is to be depressed, the coefficient alpha is greater than 1. However, when the pedal PD is going to return, the coefficient alpha is less than 1. Thus, the central processing unit 11 determines not only temporary mean current ru(temp 1) but also boost mean current ru(temp 2) before supplying the driving signal to the solenoid 28.

Subsequently, the central processing unit 11 requests the pulse width modulator 42*a* to adjust the driving signal to a duty ratio equivalent to the boost mean current ru(temp 2) as by step S206*a*. The pulse width modulator 42*a* adjusts the driving signal to the duty ratio, and supplies the driving signal to the solenoid 28 associated with the pedal PD. Then, the plunger 29 starts rapidly to project. Although the boost mean current ru(temp 2) is more than twice times larger than the mean current ru1, a boosting time period T1, over which the pulse width modulator 42*a* keeps the driving current at the duty ratio equivalent to the boost mean current ru(temp 2), is shorter than the time period T, and the overshoot and undershoot hardly take place.

Upon expiry of the boosting time period T1, the central processing unit 11 requests the pulse width modulator 42*a* to step down to a duty ratio equivalent to the temporary mean current ru(temp 1) as by step S206, and the pulse width modulator 42*a* steps down the driving signal to the duty ratio equivalent to the temporary mean current re(temp 1). The pulse width modulator 42*a* supplies the driving signal to the solenoid 28, and the pedal PD is decelerated. The pulse width modulator 42*a* keeps the driving signal at the duty ratio equivalent to the temporary mean current ru(temp 1) over a time period T2. In this instance, the total of time periods (T1+T2) is equal to the time period T.

Upon expiry of the time period T2, the central processing unit 11 requests the pulse width modulator 42*a* to step down the duty ratio equivalent to the mean current ru1 as by step S207.

Figure 6:
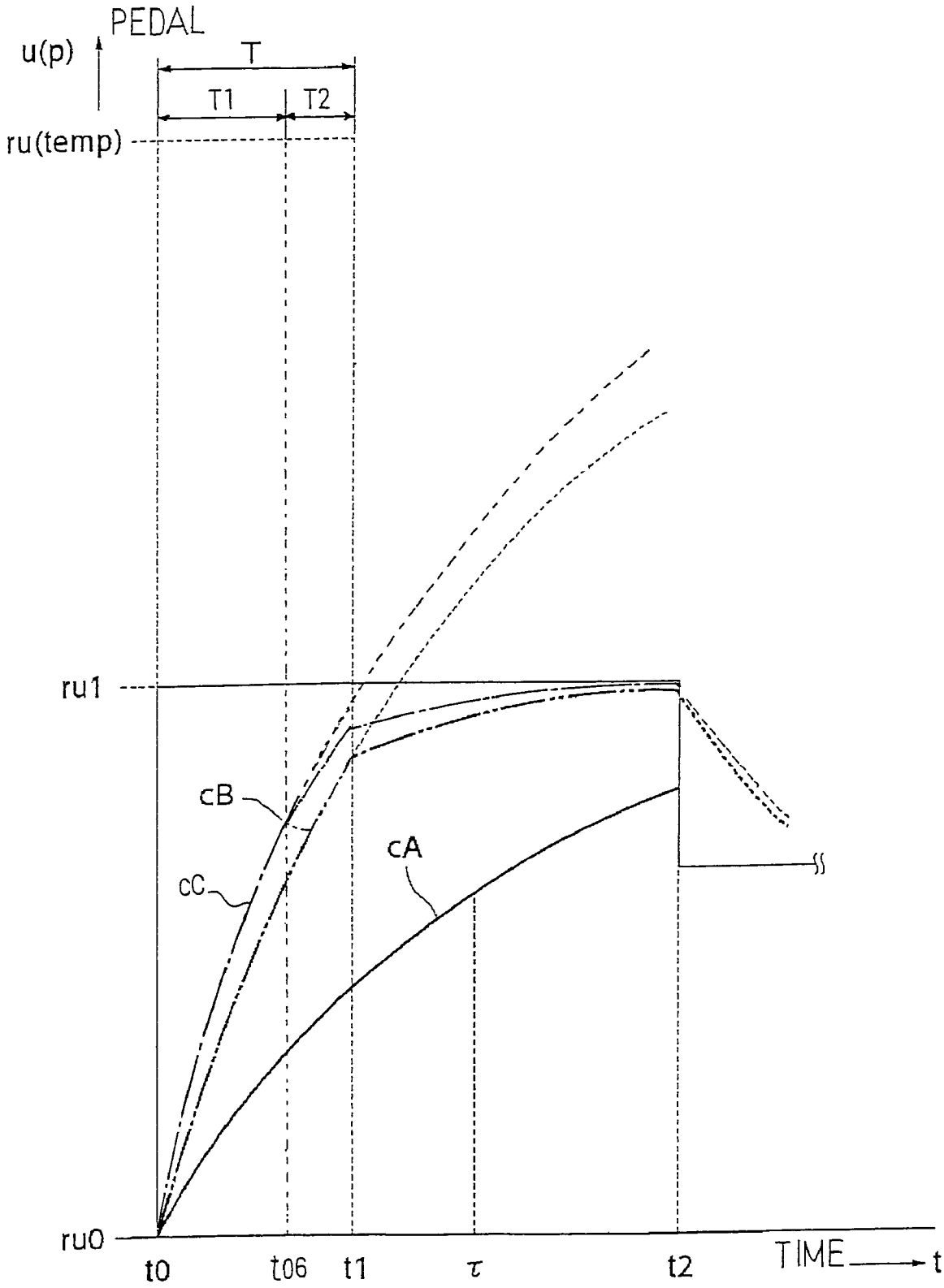
FIG. 6 is a graph showing the mean current of a driving signal supplied to a pedal actuator incorporated in another automatic player piano.

Since the duty ratio of the driving signal is twice stepped down, the plunger 29 is twice decelerated, and travels on plots cC as shown in FIG. 6. Comparing plots cC with plots cB, it is understood that the mean current in the solenoid 28 becomes closer to the mean current ru1 earlier than that of the first embodiment. This results in that the pedal motion is more faithful to the original pedal motion than the pedal motion in the automatic player piano 30.

As will be appreciated from the foregoing description, the mean current in the solenoid 28 rapidly rises toward ru1 in an early stage T of each period so that the pedal behaves as similar to that in the original performance. This results in the playback faithful to the original performance.

Although particular embodiments of the present invention have been shown and described, it will be apparent to those skilled in the art that various changes and modifications may be made without departing from the spirit and scope of the present invention.

The automatic player piano does not set any limit on the technical scope of the present invention. The present invention is applicable to any sort of automatic player musical instrument. Another automatic player musical instrument may be built on the basis of another sort of keyboard musical instrument such as, for example, an upright piano, an organ or a harpsichord. Yet another automatic player musical instrument may be built on the basis of another sort of musical instrument such as, for example, a percussion instrument, i.e., a celesta.

The present invention may be applied to the solenoid-operated key actuators. Since the solenoid has a substantial amount of inductance, it is effective against the time lag due to the large time constant. Thus, the solenoid-operated pedal actuators 26 do not set any limit to the technical scope of the present invention.

The solenoid-operated actuators do not set any limit on the technical scope of the present invention. Pulse motors are available for the automatic player, and the present invention makes the response prompt.

The recalculation cycle of 4 milliseconds do not set any limit to the technical scope of the present invention. The recalculation cycle is dependent on the number of target pedal positions Pr(p) on the reference trajectory. In a modification of the first embodiment, the jobs at steps S101 and S102 are executed by the motion controller 41 at intervals of 20 milliseconds, and the jobs at steps S103 to S107 are executed by the servo-controller 42 at intervals of 4 milliseconds. In yet another embodiment, the jobs at steps 106 and 107 may be carried out by a microcomputer.

The servo-controller 42 may insert a virtual target pedal sub-position or sub-positions into between the two target pedal position Pr(p) on the reference trajectory through an interpolation. In this instance, the servo-controller 42 compares the actual pedal position with each virtual target pedal sub-position, and the transient time period T is shorter than the time intervals among the virtual target pedal sub-positions.

The transient time period T may be shorter than or longer than 1.5 milliseconds. The ratio of the recalculation cycle to the transient time period is less than or greater than 1.5/4. The transient time period T is dependent on the recalculation cycle and the time constant. If the time constant is much larger than that of the embodiment, the transient time period T is longer than 1.5 milliseconds. For example, a designer may firstly determine an arrival time tx at which the mean current, which is expressed by plots cB, reaches ru1, and adjust the time period T to a time period shorter than the difference Tx between time t0 and time tx. The time period T may be 80% of the time period Tx. It is desirable to adjust the time period T to a multiple of the sampling time period, i.e., the intervals to repeat the step S205.

Since the duty ratio is variable between 100% and 0%, the temporary mean current ru(temp) may be equivalent to the duty ratio of 100% or to the duty ratio of zero %. Since it is impossible to increase the duty ratio over 100% and decrease it below 0%, even if the central processing unit 11 requests the pulse width modulator 42*a* to increase or decrease the mean current equivalent to a value of the duty ratio greater than 100% or less than 0% at step S106 or S206*a*/S206, the pulse width modulator adjusts the driving signal to the duty ratio of 100% or duty ratio of 0%. For this reason, if the value of the mean current ru1, which may be equivalent to the duty ratio equal to or greater than 50%, is much larger than the previous value u(p) or much smaller than the previous value u(p), it may be considered that the present invention is less effective against the time lag. However, the rapid increase or rapid decrease is not strongly required for the pedal motion in these circumstances. The rapid increase and rapid decrease is required for the long pedal stroke, and the present invention is effective against the time lag in this situation.

The ratio of ru1 to ru(temp) may be variable. The mean current rut is assumed to be increased rather than the previous one u(p). The ratio and time period T may be large and long under the condition that the previous value u(p) is relatively small. On the contrary, the ratio and time period T may be small and short under the condition that the previous value u(p) is relatively large. On the other hand, while the mean current ru1 is being reduced rather than the previous value, it is desirable to adjust the ratio and time period T to large values in so far as u(p) is relatively large.

The series of target positions on the reference trajectory do not set any limit to the technical scope of the present invention. In case where unused MIDI format may express the depth of each pedal PD from the rest position. In this instance, the pedal position codes are mixed in the other MIDI music data codes at intervals of 4 milliseconds, and the central processing unit 11 repeats step S101 at intervals of 4 milliseconds.

The mean current may be more than twice stepped down or up.

The pulse width modulator 42*a* does not set any limit to the technical scope of the present invention. The pulse with modulator 42*a* may be replaced with a variable resistor for controlling the potential level of the driving signal.

One of the temporary/boost mean currents may be calculated after the other is supplied to the solenoid 28. Thus, the steps S205*a*, S205*b*, S206*a* and S206 do not set any limit to the technical scope of the present invention.

Claim languages are correlated with the component parts of the automatic player piano 30 as follows. The black and white keys 31*a*/31*b*, component parts of action units 33, hammers 32, dampers 36, keyboard 31, pedals PD and link work PL form "plural combination of links". The strings 34 serve as "plural tone generating members". The solenoid-operated pedal actuator 26 is corresponding to "at least one actuator", and the solenoid 28 serves as a "current path". The damper pedal PD is corresponding to a "predetermined link", and the damper pedal PD, associated link work PL and dampers 36 are incorporated in "one of said plural combinations of links". The MIDI music data codes are representative of "pieces of music data". The mean current ru1 and temporary means current ru(temp) or ru(temp1)/ru(temp2) serve as a "target value" and a "temporary value", respectively. The central processing unit 11 and computer programs, which runs on the central processing unit 11, as a whole constitute a "data processor", and the pulse width modulator serves as a "driving circuit".

The solenoid-operated key actuators 20 serve as "other actuators", and the black/white keys 31*a*/31*b* are corresponding to "other links of others of said plural combinations of links".

What is claimed is:

1. An automatic player musical instrument for a performance without any fingering of a human player, comprising:

a musical instrument including plural combinations of links selectively actuated by said human player for designating tones to be produced, and plural tone generating members selectively activated by said plural combinations of links for producing said tones; and an automatic player associated with said plural combinations of links, and including at least one actuator having a current path coupled with inductance and responsive to a driving signal flowing through said current path so as to exert force on a predetermined link of one of said plural combinations of links, thereby actuating said one of said plural combinations of links, a data processor analyzing pieces of music data so as to determine target positions of said predetermined link periodically varied, a target value of current of said driving signal for bringing said predetermined link from one of said target positions to the next target position at the end of a time period without consideration of said inductance and a temporary value of said current to be supplied to said current path in an early stage of said time period so as to make said predetermined link closer to said next target position than the predetermined link driven with said driving signal at said target value and a driving circuit connected between said data processor and said at least one actuator, supplying said driving signal at said temporary value to said current path in said early stage and varying said driving signal from said temporary value to said target value at the end of said early stage.

2. The automatic player musical instrument as set forth in claim 1, further comprising other actuators respectively having other current paths coupled with other inductances and responsive to other driving signals respectively flowing through said other current paths so as to exert force on other links of others of said plural combinations of links, thereby actuating said others of said plural combinations of links without said fingering, wherein a load on said at least one actuator is heavier than a load on one of said other actuators.

3. The automatic player musical instrument as set forth in claim 2, in which said at least one actuator drives a pedal, which serves as said predetermined link, to move between a rest position and an end position, and said one of said other actuators drives a key, which serves as the link of the other of said plural combinations of links, to move between a rest position and an end position.

4. The automatic player musical instrument as set forth in claim 3, in which said pedal and said key form parts of an acoustic piano.

5. The automatic player musical instrument as set forth in claim 1, in which temporary value is constant in said early stage.

6. The automatic player musical instrument as set forth in claim 5, in which a ratio between said temporary value and said target value is equal to or less than 2.

7. The automatic player musical instrument as set forth in claim 5, in which a ratio of said early stage to said time period is equal to or less than 1.5/4.

8. The automatic player musical instrument as set forth in claim 5, in which a ratio between said temporary value and said target value is equal to or less than 2, and a ratio of said early stage to said time period is equal to or less than 1.5/4.

9. The automatic player musical instrument as set forth in claim 1, in which said temporary value is varied in said early stage at least once.

10. An automatic player for selectively driving plural combinations of links incorporated in a musical instrument, comprising:

at least one actuator having a current path coupled with inductance, and responsive to a driving signal flowing through said current path so as to exert force on a predetermined link of one of said plural combinations of links, thereby actuating said one of said plural combinations of links;

a data processor analyzing pieces of music data so as to determine target positions of said predetermined link periodically varied, a target value of current of said driving signal for bringing said predetermined link from one of said target positions to the next target position at the end of a time period without consideration of said inductance and a temporary value of said current to be supplied to said current path in an early stage of said time period so as to make said predetermined link closer to said next target position than the predetermined link driven with said driving signal at said target value; and a driving circuit connected between said data processor and said at least one actuator, supplying said driving signal at said temporary value to said current path in said early stage, and varying said driving signal from said temporary value to said target value at the end of said early stage.

11. The automatic player as set forth in claim 10, further comprising other actuators respectively having other current paths coupled with other inductances and responsive to other driving signals respectively flowing through said other current paths so as to exert force on other links of others of said plural combinations of links, thereby actuating said others of said plural combinations of links without said fingering, wherein a load on said at least one actuator is heavier than a load on one of said other actuators.

12. The automatic player as set forth in claim 11, in which said at least one actuator drives a pedal, which serves as said predetermined link, to move between a rest position and an end position, and said one of said other actuators drives a key, which serves as the link of the other of said plural combinations of links, to move between a rest position and an end position.

13. The automatic player as set forth in claim 12, in which said pedal and said key form parts of an acoustic piano.

14. The automatic player as set forth in claim 10, in which temporary value is constant in said early stage.

15. The automatic player as set forth in claim 14, in which a ratio between said temporary value and said target value is equal to or less than 2.

16. The automatic player musical instrument as set forth in claim 14, in which a ratio of said early stage to said time period is equal to or less than 1.5/4.

17. The automatic player as set forth in claim 14, in which a ratio between said temporary value and said target value is equal to or less than 2, and a ratio of said early stage to said time period is equal to or less than 1.5/4.

18. The automatic player as set forth in claim 10, in which said temporary value is varied in said early stage at least once.

* * * * *